US008734919B2

(12) United States Patent
Fu et al.

(10) Patent No.: US 8,734,919 B2
(45) Date of Patent: May 27, 2014

(54) PRE-STRESSED SUBSTRATE FOR PHOTOGRAPHIC PAPER

(75) Inventors: Xulong Fu, San Diego, CA (US); Christine E. Steichen, Escondido, CA (US); Ronald J. Selensky, Poway, CA (US)

(73) Assignee: Hewlett-Packard Development-Company, L.P., Houston, TX (US)

( * ) Notice: Subject to any disclaimer, the term of this patent is extended or adjusted under 35 U.S.C. 154(b) by 252 days.

(21) Appl. No.: 13/201,448

(22) PCT Filed: Feb. 27, 2009

(86) PCT No.: PCT/US2009/035530

§ 371 (c)(1),
(2), (4) Date: Aug. 12, 2011

(87) PCT Pub. No.: WO2010/098770

PCT Pub. Date: Sep. 2, 2010

(65) Prior Publication Data

US 2011/0293859 A1 Dec. 1, 2011

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/52* (2013.01); *B41M 5/506* (2013.01); *B41M 5/5254* (2013.01)

USPC ..... 428/32.21; 428/32.34; 428/32.35

(58) Field of Classification Search

CPC ..... B41M 5/5218; B41M 5/52; B41M 5/506; B41M 5/5254

USPC ..... 428/32.21, 32.34, 32.35

See application file for complete search history.

(56) References Cited

U.S. PATENT DOCUMENTS

| | | | | |
|---|---|---|---|---|
| 6,872,430 | B2 | 3/2005 | Burch et al. | |
| 2003/0064201 | A1 * | 4/2003 | Xing et al. | 428/195 |

(Continued)

FOREIGN PATENT DOCUMENTS

| | | | |
|---|---|---|---|
| CN | 1653145 | A | 8/2005 |
| CN | 1662385 | A | 8/2005 |

(Continued)

OTHER PUBLICATIONS

CPCH1161164P—Office Action from Peoples Republic of China (PRC) in Chinese, dated May 3, 2013, 11 pages, for counterpart CN application No. 200980157643.4.

List of References Cited (English) and Japan Office Action (Japanese) dated Aug. 6, 2013 from Japan Patent Office for foreign counterpart patent application No. JP2011-552010 (3 pages).

*Primary Examiner* — Betelhem Shewareged

(57) ABSTRACT

A pre-stressed substrate for a photographic paper includes a base paper having a front surface and a back surface; a top pre-stress coat on the front surface, the top pre-stress coat including a first pre-stress mixture containing at least a first pigment, a first binding material including a first water soluble binder and a first water-dispersible binder; and a back pre-stress coat on the back surface, the back pre-stress coating including a second pre-stress mixture containing at least a second pigment, a second binding material including a second water soluble binder. The weight % of the first water soluble binder in the first binding material is less than the weight % of the second water soluble binder in the second binding material. The pre-stressed substrate has a predetermined degree of curvature toward the back surface and is capable of countering curling forces that occur when the pre-stressed substrate is used.

13 Claims, 9 Drawing Sheets

(56) References Cited

U.S. PATENT DOCUMENTS

| | | | | |
|---|---|---|---|---|
| 2003/0064208 | A1* | 4/2003 | Yamada et al. | 428/195 |
| 2003/0081103 | A1* | 5/2003 | Ishimaru et al. | 347/105 |
| 2003/0211293 | A1* | 11/2003 | Nemoto et al. | 428/195 |
| 2004/0002570 | A1 | 1/2004 | Parrinello et al. | |
| 2004/0219310 | A1 | 11/2004 | Ogata et al. | |
| 2005/0233098 | A1 | 10/2005 | Asano et al. | |
| 2006/0068133 | A1 | 3/2006 | Khoultchaev et al. | |
| 2007/0207278 | A1 | 9/2007 | Mukherjee et al. | |
| 2008/0090033 | A1* | 4/2008 | Fu et al. | 428/32.39 |
| 2008/0166507 | A1 | 7/2008 | Park et al. | |

FOREIGN PATENT DOCUMENTS

| | | | |
|---|---|---|---|
| JP | 1994143796 | A | 5/1994 |
| JP | 08-011421 | A | 1/1996 |
| JP | 2004276402 | A | 10/2004 |
| JP | 2004330483 | A | 11/2004 |
| JP | 2006159759 | A | 6/2006 |

* cited by examiner

PRE-STRESSED SUBSTRATE FOR PHOTOGRAPHIC PAPER

BACKGROUND

The present invention relates to microporous type inkjet photographic papers containing a resin coated photo base or substrate, and more particularly to such photo bases and papers formulated to reduce or offset curling.

BRIEF DESCRIPTION OF THE DRAWINGS

For a detailed description of exemplary embodiments of the invention, reference will now be made to the accompanying drawings in which.

NOTATION AND NOMENCLATURE

Figure 1:
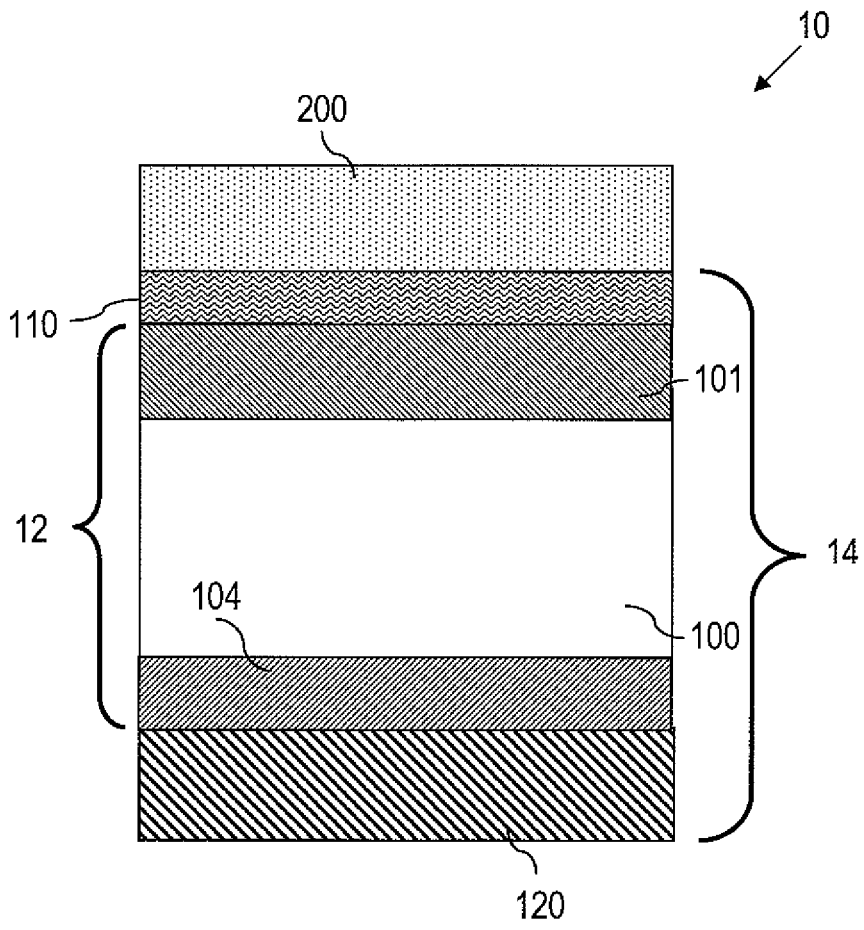
FIG. 1 is a schematic cross-section view of a pre-stressed photo product construct with layers on both sides of a raw base paper, in accordance with various embodiments. The cross-section is taken from front to back (printing surface to back side) across the length of the substantially planar product.

Certain terms are used throughout the following descriptions and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ."

"Raw Base" refers to a base paper that contains any suitable type of cellulose fiber, or combination of fibers known for use in paper making. Various functional or performance additives as are known in the art of papermaking may be included.

"Fiber furnish" refers to the basic ingredients that make up a paper, usually including cellulose fibers from trees or other plants.

The term "water dispersible binder" refers to polymer materials that are not appreciably soluble in water, but are capable of being dispersed in water.

A "water soluble binder" is a binder material that is soluble in water, such as polyvinyl alcohol (PVA), starch derivatives, gelatin, cellulose derivatives, acrylamide polymers and the like.

"Curling" of a photographic paper, or a photographic base paper, refers to the upward or downward curve of edges of a planar sheet. Curling typically occurs due to temperature and humidity changes in the paper's environment, or during or after printing.

The term "substantially flat," when referring to a pre-stressed photographic paper product or an intermediate pre-stressed base paper, means that the amount of upward or downward curvature of the product is within ±5 mm.

"Pre-stressed base paper" refers to a raw base paper form (e.g., not yet extruded), which has a predetermined negative curl by design.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Microporous type inkjet photographic papers typically contain a resin coated photo base or substrate. In many cases, the papers are a composite of layers of various materials on a raw paper stock. These photographic papers tend to curl as a result of differing sensitivities of the materials to temperature and humidity, and due to differential expansion or shrinkage between the image receiving layer materials and the back of the print medium during manufacturing, drying, printing and storage. In composite papers containing multiple coatings or layers, the problem of expansion and shrinkage of the different materials is increased. Curling of photo papers complicates handling and storage, and is also detrimental for esthetic reasons. For digital photographic printing such as inkjet printing, a flat sheet is highly desirable at all environmental conditions that the paper is likely to encounter during use or storage. When a photo paper has too much positive curl (i.e., toward the image receiving layer), the inkjet print head will tend to scrape the paper and cause a print jam or print defect. Too much negative curl (i.e., toward the back side) can cause sheet feeding problems in the paper handling tray.

In an effort to counteract curling, a photo base paper is typically pre-stressed by applying excess resin to the back side of the paper during manufacturing. This excess of resin causes the base paper to curl toward the back side. Then, when the front side coating is applied and dried, or otherwise exposed to curl inducing conditions, the pre-stressed back side curl tends to counterbalance the front side coating and drying stresses to flatten the final photo paper. When polyethylene (PE) is applied to both the front side (i.e., image forming side) and the back side, the ratio of the back side PE weight to front side PE weight is typically more than 1.5. There is a practical limit to the amount of resin that can be applied to the back side of the paper, however. Not only is the cost of the additional resin a concern, there is a limit to the amount of curl that can be off-set in this manner. In many instances, increasing the amount of back side PE produces curl compensation that does not evenly compensate for changes in the environmental condition. As a result, the print medium may be a flat sheet at one condition, and significantly curled at another environmental condition. Differential curling of inkjet photo papers at different extremes of temperature and relative humidity occurs in many cases. Accordingly, there is continuing interest in developing ways to reduce or offset curling in inkjet photographic papers.

Pre-Stressed Raw Base Paper

A pre-stressed raw base paper 12 as illustrated in cross-section in FIG. 1 is produced prior to the resin extrusion process during manufacture of the photo base paper in a paper making machine, or in a combination of paper making machine and an off-line coater. Pre-stress is built into a raw base paper 100 by applying different pigment coating layers to each side of the raw base paper. The pigment coat 101 on the front side differs from the pigment coat 104 on the back side. One such difference is the nature of the binder material used for forming each of the coats 101, 104. Specifically, the weight % of water soluble binder ($WSB_1$) in the binder material on the front side is less than the weight % of water soluble binder ($WSB_2$) in the binder material on the back side. The weight % of $WSB_1$ is the dry weight of $WSB_1$ divided by the combined dry weight of $WSB_1$ and water dispersible binder ($WDB_1$). The weight % of $WSB_2$ is the dry weight of $WSB_2$ relative to the combined dry weight of $WSB_2$ and $WDB_2$. In an exemplary embodiment, the wt % of water soluble binder in the front side pigment coating 101 (relative to total binder material in that layer) is in the range of 0 wt % to 50 wt %, and the wt % of water soluble binder in the back side pigment coating 104 is in the range of 50 wt % to 100 wt % (relative to total binder material in that layer). In some embodiments, the pigments used in coats 101 and 104 are of the same kind. In some embodiments the pigments used in coats 101 and 104 are different kinds. In some embodiments, the particle size of the pigment used in coat 101 is smaller than that used in coat 104. The composition of the pre-stressed raw base paper is further described as follows:

Base Stock

Referring to FIG. 1, pre-stressed inkjet photo base paper 14 includes a raw base stock 100 such as a cellulose paper that has coating compositions applied to it. The raw base paper comprises any suitable type of cellulose fiber, or combination of fibers known for use in paper making. For example, it can be made from pulp fibers derived from hardwood trees, softwood trees, or a combination of hardwood and softwood trees prepared for use in papermaking fiber. For some applications, all or a portion of the pulp fibers are obtained from non-wood fiber such as kenaf, hemp, jute, flax, sisal and abaca, bamboo and bagass for example. Certain types of recycled pulp fibers are also suitable for use. Additives that may be added include, but are not limited to, internal sizing agents such as metal salts of fatty acids and/or fatty acids, alkyl ketene dimer emulsification products and/or epoxidized higher fatty acid amides; alkenyl or alkylsuccinic acid anhydride emulsification products and rosin derivatives; retention aids such as cationic polyacrylamide and cationic starch or anionic silica-based system; dry strengthening agents such as anionic, cationic or amphoteric polyacrylamides, polyvinyl alcohol, cationized starch and vegetable galactomannan; wet strengthening agents such as polyaminepolyamide epichlorohydrin resin; fixers such as water-soluble aluminum salts, aluminum chloride, and aluminum sulfate; pH adjustors such as sodium hydroxide, sodium carbonate and sulfuric acid; and coloring agents such as pigments, coloring dyes, and fluorescent brighteners.

Any of a number of fillers may be included in various amounts in the paper pulp during formation of the raw base paper, to control physical properties of the final base paper or replace fiber to save cost, depending upon the particular requirements of a given application. Some suitable fillers are ground calcium carbonate, precipitated calcium carbonate, titanium dioxide, kaolin clay, and ATH, to name just a few, may be incorporated into a pulp. In some embodiments, the cellulose base paper has a basis weight ranging from 50 to 250 gsm, and in some embodiments, the filler content is between 10 and 30 wt %.

Pre-Stress Coats

The front and back pre-stress coats 101, 104 contain selected pigments and binding materials containing selected binders or combinations of binders. The pigment coats may also include one or more other additives such as deformers, surfactants, leveling agents, dyes, and optical bleaching agents (OBAs). The binding material provides binding adhesion among pigment particles and also provides adhesion between pigment particles and the cellulose fibers of the raw base stock. Examples of suitable water-soluble binders include, but are not limited to, polyvinyl alcohol, starch derivatives, gelatin, and cellulose derivatives. Examples of suitable water-dispersible binders include, but are not limited to, acrylic polymers or copolymers, vinyl acetate latex, polyesters, vinylidene chloride latex, and styrene-butadiene or acrylonitrile-butadiene copolymer latex.

Suitable pigments used in the pre-stress coats 101, 104 include inorganic pigments with relatively low surface area (e.g., less than 100 $m^2/g$). Examples of suitable pigments include, but are not limited to, clay, kaolin, calcium carbonate, talc, titanium dioxide, silica, calcium silicate, ATH and Zeolite. Additionally, organic pigments such as polyethylene, polymethyl methacrylate, polystyrene and its copolymers, and polytetrafluoroethylene (Teflon®) powders, and combinations of these pigments may be used in coat 101 and/or coat 104. In some embodiments the organic pigments are in the solid state form. In some embodiments "hollow" organic particles are used.

Front Pre-Stress Coat The front pre-stress coat 101 contains binding material that is a mixture of water-soluble binder and water-dispersible binder, in which the water-soluble binder ($WSB_1$) is less than 50% by weight of the total binding material ($TBM_1$) in coat 101. In some instances, the $WSB_1$ is less than 20 wt % of the $TBM_1$. Accordingly, in some embodiments, the front pre-stress coat 101 contains only water-dispersible binder (i.e., 100 wt % $WDB_1$), and no water soluble binder ($WSB_1$) at all. Front pre-stress coat 101 also contains selected inorganic or organic pigments. In some embodiments, plastic pigments make up about 5-10 wt % of the total pigment in coat 101. In some embodiments, the total amount of pigment in pre-stress coat 101 is in the range of 50 to 85% by total dry weight of the pre-stress coating composition applied to the front surface.

Figure 2:
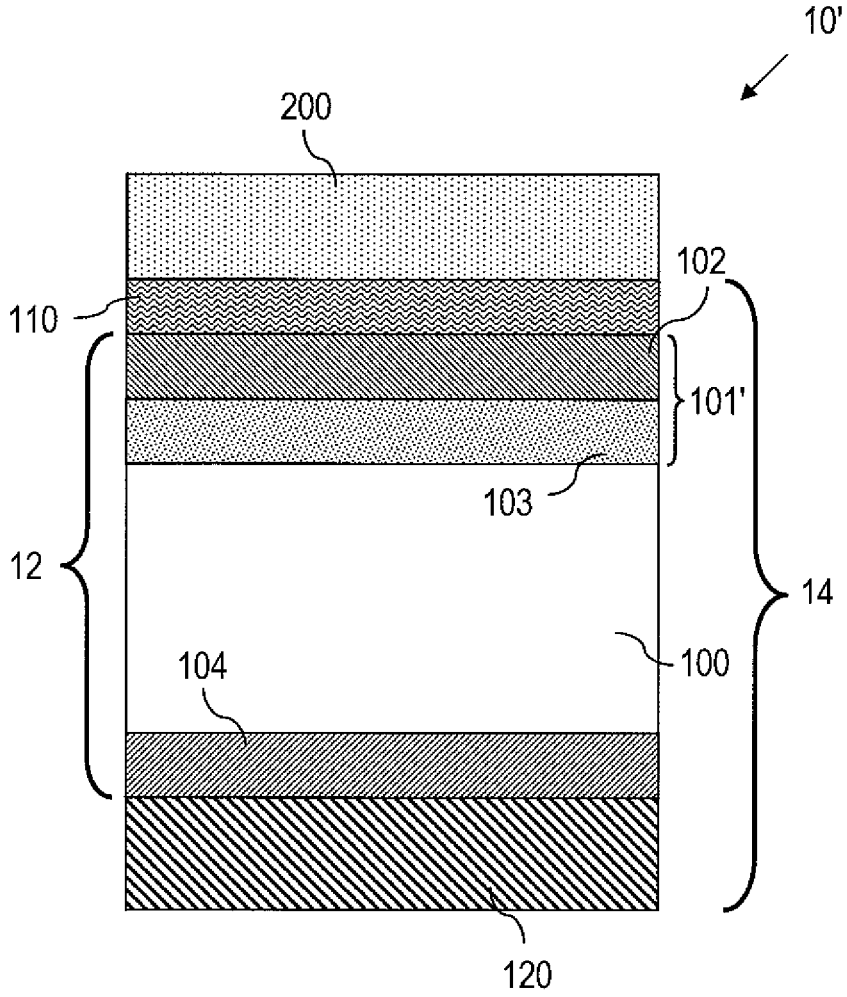
FIG. 2 is a schematic cross-section view of another pre-stressed photo product construct with layers on both sides of a raw base paper, in accordance with various embodiments.

Referring to FIG. 2, in a variation of the embodiment illustrated in FIG. 1, the front side pre-stress coating 101' includes a top coat 102 and an under coat 103 that is located between the base paper 100 and top coat 102. In some embodiments, the undercoat 103 contains lower mean surface area pigment (i.e., larger mean size pigment particles), such as HYDROCARB 60 (ground calcium carbonate) from Omaya, for example; and top coat 102 contains relative higher mean surface area pigment (i.e., smaller mean size pigment particles), such as OPACARB A40 precipitated calcium carbonate from SMI, or plastic pigment such as DPP 3720 from Dow Chemical, for example. In some embodiments the same size pigment particle is used in coats 102, 103. The same binding material is used in coats 102 and 103 in some cases. In other cases, the binding materials in coats 102 and 103 are different. In top pre-stress coat 101', first pre-stress coat 102 and undercoat 103 contain binders such as those water soluble and water dispersible binders identified above. In some embodiments, a top pre-stress coating configuration that includes separate coats 102, 103 potentially provides better extruded base and final product qualities such as unimaged gloss and perceived gloss or image clarity.

Back Pre-Stress Coat. In the back side pre-stress coat 104, the amount of water-soluble binder (percentage by weight of the total binder used in the layer) is more than 50%. Thus, in some embodiments, the back pre-stress coat 104 contains only water-soluble binder (i.e., 100 wt % water-soluble binder), and no water dispersible binder at all. In other embodiments, the back pre-stress coat 104 includes a mixture of water-soluble binder and water-dispersible binder. In some embodiments, the coat weight of the back pre-stress coat 104 is 1-3 times that of the top pre-stress coat 101. The types and amount(s) of binders used in the formulation of each pre-stress coat 101, 102, 103 and 104 (FIGS. 1-2) is related to the type and amount of pigments selected, as well as the degree of pre-stress desired in the resulting coating. For example, small particle size/higher surface area pigments require more binder to hold the individual particles together than larger particle size/lower surface area pigments. The relationship of binder amount to pigment type and amount, and degree of pre-stress is further described and exemplified in Examples 1-7, below. In some embodiments, the back pre-stress coat 104 is also divided into two different layers (not shown), similar to layers 102 and 103 described above with respect to the top pre-stress coat 101. For instance, if the back side requires a very high coat weight, the coat 104 can be applied as two separate coats.

In some embodiments, a pre-stressed coated raw base paper 12 makes it possible to use a significantly reduced amount of back side polyethylene film (polymeric film layer 120) compared to other pre-stressed base papers, to reach a desired pre-stress level for the final inkjet photographic paper substrate or photo media 10.

Pre-Stressed Photographic Base Paper

As illustrated in schematic cross-section in FIGS. 1 and 2, a pre-stressed photographic base paper or substrate includes a first polymeric film 110 disposed on the top pre-stress layer 101 or 101', and a second polymeric film 120 disposed on the back pre-stress layer 104. Some suitable polymer films include, but are not limited to, high density polyethylene (HDPE), low density polyethylene (LDPE), linear low density polyethylene (LLDPE), polypropylene (PP), and combinations of any of those polymers. In some embodiments, the weight ratio of the polymeric film 120 on the back side to the polymeric film on the front side is less than 2.0, and in some embodiments, the ratio is less than 1.5.

Pre-Stressed Inkjet Photographic Paper

Referring still to FIGS. 1 and 2, a pre-stressed inkjet photographic paper or photo print media 10 includes a porous image receiving layer 200 disposed over the polymeric film layer 110 of the above-described photographic base paper 14. The image receiving layer comprises any suitable porous inkjet image receiving composition such as a high porosity inorganic oxide dispersion plus a binder and other additives as are known to those of skill in the art. For example, in some embodiments the high-porosity, inorganic-oxide dispersion includes any number of inorganic oxide groups including, but not limited to, a fumed silica or alumina, treated with silane coupling agents containing functional groups. In some embodiments, a microporous ink receiving layer 200 includes approximately 20-40 gsm of high porosity inorganic oxide dispersion plus a binder and other additives.

In some embodiments, the resulting pre-stressed coated raw base paper 12 extends the maximum pre-stress capability beyond that which was previously possible in a conventional non-pre-stressed base paper. Still other potential advantages of various embodiments include increased opacity of certain pre-stressed photographic base papers 14 and final pre-stressed photographic papers 10. Certain embodiments of the pre-stressed raw base papers 12, pre-stressed photographic base papers 14, and final pre-stressed photographic papers 10 potentially improve the ability of the product to equilibrate to changes in environmental moisture. In many embodiments, a photobase 14 is provided that is able to have a more equal expansion or contraction response between the front and back sides of the sheet. The use of this photobase produces a final coated product 10 that will potentially remain closer to a flat sheet at each environmental condition at which the product is used.

Manufacturing Process

Referring to FIG. 1 or 2, production of a pre-stressed base paper 14 for an inkjet image receiving layer 200 generally includes forming a pulp slurry that is distributed in a headbox onto a moving, continuous wire, where water drains from the slurry by gravity, or aided by vacuum. The wet paper sheet then goes through presses, driers and calenders, and the resulting paper is finally rolled into large rolls. The above-described pre-stress pigment coats are applied with a metering sizing press in-line on the paper machine. Each pre-stress coating may also been applied using an off-line coater such as rod, roll, blade, curtain, cascade, gravure, air knife coaters, or the like. The pre-stress coated raw base 12 is then calendered either in-line on the paper machine or off-line with hard nip, softnip or super-calender. From the resulting pre-stressed raw base 12 a resin coated base paper 14 is produced by extruding a layer of polymeric resin on each side using an extruder. Then the micro porous ink receiving layer 200 is coated onto the resin coated base paper 14 using a coater such as curtain or slot die coater.

A first pre-stress coating mixture is prepared by combining an aqueous medium, the selected pigments, one or more water-soluble binder, one or more water-dispersible binder, and any desired additives, for forming the front pre-stress coat 101. A second pre-stress coating mixture is similarly prepared by combining an aqueous medium, the selected pigments, one or more water-soluble binder, and any desired additives, for forming the back pre-stress coat 104. In some cases, the second pre-stress coating mixture also includes one or more water-dispersible binder.

The pre-stress coating mixtures or compositions are applied to the front and back sides, respectively, of raw base paper 100 using any suitable technique and apparatus. For example, the pre-stress coating mixtures may be applied during raw base paper making by an in-line surface size press process such a film-sized press, or using a film coater, as described above. Alternatively, the coatings may be applied off-line, after raw base paper making, using any suitable coating technology, including, but not limited to, slot die coaters, cascade, roll coaters, curtain coaters, blade coaters, rod coaters, air knife coaters, gravure application, air brush application and other techniques and apparatus known to those skilled in the art. In some instances, the coating compositions are directly applied on both sides of the base stock simultaneously.

Referring to FIG. 2, in embodiments of the process in which the first pre-stress coat 101' contains separate pre-stress coat 102 and pre-stress undercoat 103, the respective coating mixtures containing the different pigment and binder combinations (as described above) and a suitable aqueous medium are applied to the base 100 in the respective order. In some embodiments, the undercoat 103 is applied first and dried before forming the top pre-stress coat 102. In some alternative embodiments, the top coats 102 and 103 are applied at the same time using a multi-layer coater such as a multi-layer curtain or cascade coater. In embodiments in which coat 104 is similarly divided into two separate coats (not shown), they are applied as described above with respect to coats 102 and 103.

After the pre-stress coats 101 or 101' and 104 (FIGS. 1 and 2) have been applied, the resulting pre-stressed coated base paper 12, is then calendered to improve surface smoothness which will potentially improve the perceived gloss of the final product. Any suitable in-line or off-line calendering technique may be used, including, but not limited to, a hard nip, soft nip or super-calender technique.

After the first and second pre-stress coating mixtures are applied to the respective front and back sides of the raw base paper 100, it is dried and calendered which results in a pre-stressed coated raw base paper 12. The coated raw base paper is then extrusion coated with a first polymeric resin layer 110 over the top pre-stress coat 101 or 101'. Similarly, a second polymeric resin layer 120 is applied to back pre-stress coat 104, either simultaneously with or at a different time from application of the first polymeric mixture to the top pre-stress coat. In some embodiments the sequence of extrusion includes extruding the resin layer 120 first and extruding the resin layer 110 second, to minimize potential damage to the imaging side of the product. Some suitable extrudable resins include, but are not limited to, high density polyethylene (HDPE), low density polyethylene (LDPE), linear low density polyethylene (LLDPE), polypropylene (PP), and combinations of those polymers. In some instances, the weight ratio of the resulting polymeric film 120 on the back side to the polymeric film on the front side is less than 2.0. In some cases, the ratio is less than 1.5. After forming polymeric film layers 110, 120, the resulting product is an extruded photographic base paper 14. In some embodiments, a porous image receiving layer 200 is then formed over polymeric layer 110 by applying a composition containing a high-porosity, inorganic metal oxide dispersion which may include one or more inorganic metal oxide groups. Such inorganic metal oxide groups include, but are not limited to, a fumed silica or alumina treated with silane coupling agents containing functional groups. Silane coupling agents comprise a functional moiety (or portion of the reagent that provides desired modified properties to an inorganic particulate surface), which is covalently attached to a silane grouping. The organosilane reagent can become covalently attached or otherwise attracted to the surface of semi-metal oxide or metal oxide particulates. The functional moiety portion of the organosilane reagent can be directly attached to the silane grouping, or can be appropriately spaced from the silane grouping, such as by from 1 to 10 carbon atoms or other known spacer groupings. The silane grouping of the organosilane reagent can be attached to semi-metal oxide or metal oxide particulates of the porous media coating composition through hydroxyl groups, halide groups, or alkoxy groups present on the reagent. Alternatively, in some instances, the organosilane reagent can be merely attracted to the surface of the inorganic particulates. The term "functional moiety" refers to an active portion of an organosilane reagent that provides a function to the surface of the inorganic metal oxide particulates. In accordance with embodiments of the present invention, the functional moiety can be any moiety that is desired for a particular application. In one embodiment, the functional moiety is primary, secondary, tertiary, or quaternary amines. In one embodiment, amines are particularly useful as the functional moiety when the pH of the porous ink-receiving layer and/or the pH of the ink-absorbing layer are less than about 6, and preferably from about 3 to about 5. Such pH values cause the amines to be protonated or cationic, which can attract anionic colorants that may be present in ink-jet inks.

In some embodiments, the resulting pre-stressed photographic paper is designed to adjust its curl compensation in concert with the particular demands (e.g., tensile or compressive forces) from the imaging layer, in any environmental condition in the ranges of 15-32° C. and 20-80% relative humidity.

Examples of the new pre-stressed photographic base papers and pre-stressed photographic papers are set forth below. These Examples are merely illustrative and are not intended to limit the claims in any way.

Examples

A series of pre-stressed base papers were prepared using the following procedure:

(1) The paper substrates that were used for the media in this example were made on a paper machine from a fiber furnish consisting of 80%-100% hardwood fibers, 0%-20% softwood, and up to 25% precipitated calcium carbonate with alkyl ketene dimers (AKD) internal size. The basis weight of the substrate paper was about 160-170 gsm. The raw base paper substrates were coated with different coat weights and different levels of the water soluble binder in the back side pre-stress coating.

(2) The coating composition for each media sample in this example was prepared in the laboratory. The appropriate amount of water is first charged into the vessel followed by inorganic pigments and other polymeric binders and/or additives such as polyvinyl alcohol. Optionally, other coating additives such as pH control agent, water retention agent, thickener agent and surfactant can be added into the vessel.

(3) The coating process was accomplished either in small quantities by hand drawdown using a Mayer rod in a plate coating station, or in a large quantity by a pilot coater equipped with a slot die as the metering device. The coating weight of the coating was from about 5 to about 30 gsm for the backside, and 0 to 25 gsm for the front side. The exemplary formulations of the surface coating composition are shown as a non-limiting example in Table 1 and Table 2. Parts are by dry weight, and coat weights are dry coat weights. The fraction of the individual component parts divided by the sum of the coating parts yields the dry weight fraction, corresponding to the above-described water soluble binder (WSB) and water dispersible binder (WDB) terminology.

TABLE 1

| Front side coating Parts | Material | Backside coating Parts | Material |
|---|---|---|---|
| 0-60 | Hydrocarb 60 ™ | 100 | Hydrocarb 60 ™ |
| 40-100 | Opacarb A40 ™ | 10-20 | Mowiol 6-98 ™ |
| 5-10 | DPP 3720 ™ | 5 | starch |
| 10-15 | Rovene 4040 ™ | 1-2 | Glyoxal ™ |
| 0-5 | starch | 0-5 | $CaCl_2$ |
| 0-10 | $CaCl_2$ | 1-2 | Glycerol |
| 1-4 | Glycerol | | |

TABLE 2

| | | Front side Water Soluble Binder | | Front side Coat | Back side Water Soluble Binder | | Back side Coat |
|---|---|---|---|---|---|---|---|
| Variants | Raw Base | Mowiol 6-98 ™ (%) | Starch | weight (gsm) | Mowiol 6-98 ™ (%) | Starch | weight (gsm) |
| Sample 1 | 160 gsm | 0% | 4% | 8 | 8% | 4% | 15 |
| Sample 2 | 160 gsm | 0% | 4% | 8 | 15% | 4% | 15 |
| Sample 3 | 160 gsm | 0% | 4% | 0 | 15% | 4% | 15 |
| Sample 4 | 160 gsm | 0% | 4% | 5 | 15% | 4% | 15 |
| Sample 5 | 160 gsm | 0% | 4% | 10 | 15% | 4% | 15 |
| Sample 6 | 160 gsm | 0% | 4% | 15 | 15% | 4% | 15 |
| Sample 7 | 170 gsm | 0% | 4.5% | 15 | 13% | 4.5% | 15 |
| Sample 8 | 170 gsm | 1% | 0% | 25 | 10% | 0% | 25 |
| Sample 9 | 170 gsm | 0% | 0% | 0 | 0% | 0% | 0 |

The sources of the components identified in Tables 1 and 2 are as follows: OPACARB A40 is precipitated calcium carbonate from SMI; HYDROCARB 60 is ground calcium carbonate from Omaya; $CaCl_2$ is salt from Tetra Technologies, Inc.; Glycerol is a plasticizer from Aldrich; MOWIOL 6-98 is a polyvinyl alcohol, available from Clariant Corporation; ROVENE 4040 is a styrene butadiene latex emulsion, available from Mallard Creek Polymers, Inc; Starch is from Grain Processing Corporation, and DPP 3720 is a plastic pigment from Dow Chemical. GLYOXAL is a cross linker agent from BASF.

(4) The pre-stressed coated raw base paper was then calendared at 23° C. under a pressure of from 1000 to 3000 pound per square inch (psi) using a laboratory soft-calender.

(5) After lab calendering the coated base above, samples were either lab lamination or pilot extruded. Lab lamination was used to apply moisture barrier material to both side of the coated base (pre-stressed base: Samples 1 to 6 in table 2). Films used in the lamination for both sides of Samples 1 to 6 are the same thickness (i.e., 15 gsm at both sides). For a different set of pre-stress coated samples, the moisture barrier was extruded with a pilot extruder to apply PE to both sides of the base (Samples 7 and 8 in Table 2). About 15 gsm LDPE was extruded on the front side of Samples 7 and 8, and 25 gsm of 60/40 ratio of HDPE to LDPE was applied to the back side of the Samples 7 and 8. Sample 9 represents a comparative sample using a conventional design, and was used as a control for Samples 7 and 8. Comparative Sample 9 has the same amount of PE applied as Samples 7 and 8.

(6) The laminated or pilot extruded base was then evaluated in different environmental chambers.

Figure 3A:
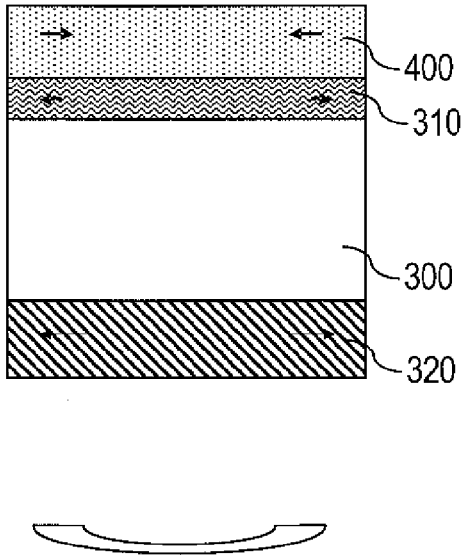
FIGS. 3A-B are schematic illustrations of photo paper constructs showing comparative stress changes in final photo papers created at 32° C. and 20% relative humidity, compared to the same papers created at 23° C. and 50% relative humidity. A: a prior art photo product and a representation of the prior art photo product's curvature; B: a pre-stressed photo product according to various embodiments, and a representation of the curvature of that produce.
Figure 3B:
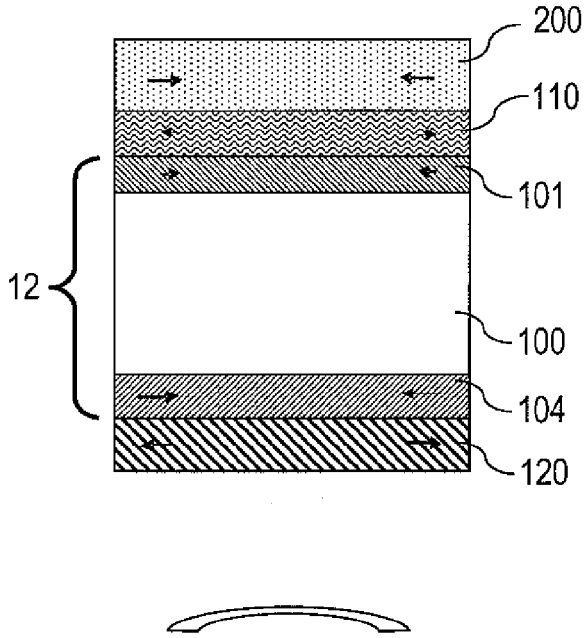

As illustrated schematically in FIG. 3B, after applying the ink receiving layer 200, the pre-stress coats 101 and 104 in the coated raw base paper 12 will maintain downward curl (i.e., edge curvature toward the back side of the paper), when the photo paper is conditioned at a relatively warm, dry environmental condition (e.g., 32° C./20% relative humidity). Edge curl is a result of the specific forces produced at a given environmental condition. The concave downward configuration of the sheet is illustrated in FIG. 3B below the corresponding layered product. The arrows in the figures indicate the direction of stretching or contracting (i.e., tensile or compressive forces) of the various layers. The arrow lengths indicate the relative stretching or contracting forces of the respective layers.

Biased stress that is "locked in" during extrusion application of layers 110, 120 remains environmentally responsive after film layers 110, 120 and the imaging layer 200 is applied, to form the final photo base paper 14. Therefore, the photo base paper 14 will also have a predetermined degree of curvature towards the back side as desired to counter the stress created by the porous image receiving layer 200 on the front side of the final photo paper product 10. In contrast, resin layers 310, 320 on the respective front and back sides of raw base paper 300 of a comparative, conventional (prior art) photo paper, as schematically illustrated in FIG. 3A, when conditioned in 32° C./20% will curl upward (i.e., edge curvature upward toward the front side of the paper). The upward curl is schematically illustrated below the corresponding comparative photo paper product. The upward curl often causes imaging defects and sheet feeding issues when the photographic paper is printed with an inkjet printer.

Figure 4A:
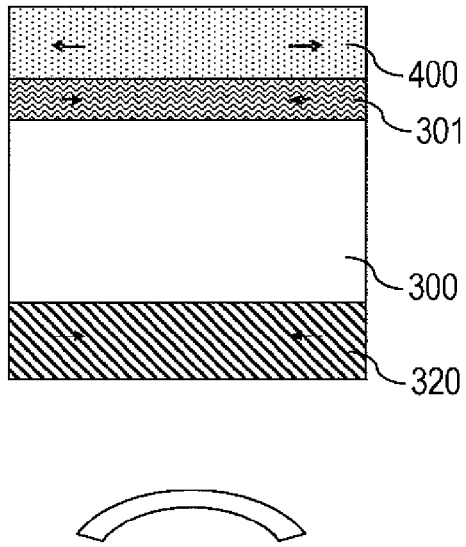
FIGS. 4A-B are schematic diagrams of photo paper constructs showing comparative stress changes in final photo papers created at 15° C. and 80% relative humidity, compared to the same papers created at 23° C. and 50% relative humidity. A: a cross-section of a prior art photo product and a representation of the curvature of a prior art photo product; B: a cross-section of a pre-stressed photo product according to various embodiments, with a representation of the curvature of that product below.
Figure 4B:
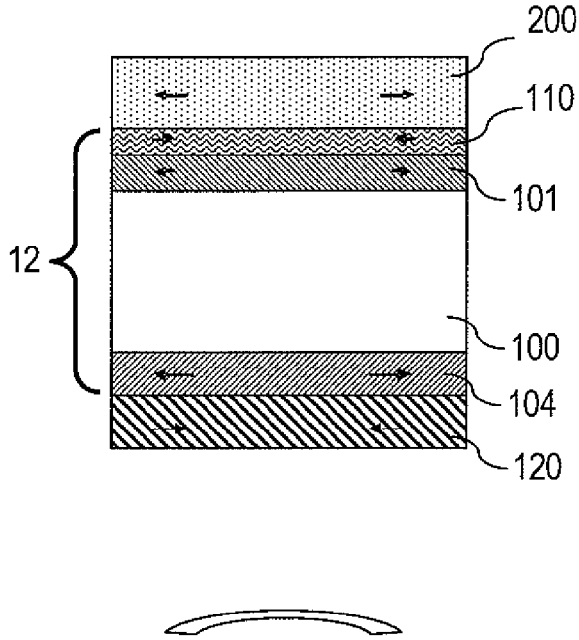

Referring now to FIG. 4B, when a photo paper like that of FIG. 3B is conditioned at a relatively cold, wet environmental condition (e.g., 15° C./80% RH) the pre-stress coating 104 expands, which will counter balance the expansion stress from the ink receiving layer 200. This counter balancing force will prevent the final product from having too much curl toward the back side. With respect to comparative, conventional photo papers under a similar cold, wet condition, as illustrated in FIG. 4A, the back side PE layer 320 will shrink while the ink receiving layer 400 will expand. The direction of stretching and contracting of layers 310 and 320 are reversed, compared to FIG. 3A, as indicated by the directions of the arrows. The combined force from layers 320 and 400 will cause the final photo paper to have a much greater downward curl (i.e., toward the back side) as compared to the condition of 23° C./50% RH.

The amount of curling of the photographic base paper or finished photo paper is measured by placing the sample sheet on a flat plane at a specific condition of temperature and relative humidity (e.g., 23° C. and 50% RH). The heights of four end points of the corners of the sample sheet from the flat plane are measured, and the amount of curl of the sheet is represented by an average of the heights of the four corner points. A conventional photo paper typically exhibits an amount of curl of about −5 mm to about 5 mm at 50% RH at TAPPI standard conditions of 23° C./50% RH.

In the final photo paper (FIGS. 3B and 4B) the water soluble binder in the back side pre-stress pigment coat 104 will counter balance the stress generated from the image receiving coating layer 200. This is of potential practical use because the back side pre-stress coat 104 on raw base 100 is designed to respond in a way similar to the image receiving layer 200 during use of the print media. For example, when the media is conditioned in a hot, dry condition (such as 32° C./20% RH), the back side pre-stress coat 104 will shrink, and that shrinkage will counter balance the shrinkage stress from image receiving layer 200 on the front side (image receiving side). It also counter balances the expansion stress from the back side polymeric film 120 (e.g., PE layer). The amount of pre-stress in the coated raw base 12 is controlled by the relative amount of the water-soluble binder in the back pre-stress coat 104 (as demonstrated in FIG. 8), as well as the coat weight difference between the back side 104 and front side (top) 101 pre-stress coatings (as demonstrated in FIG. 9).

Figure 5A:
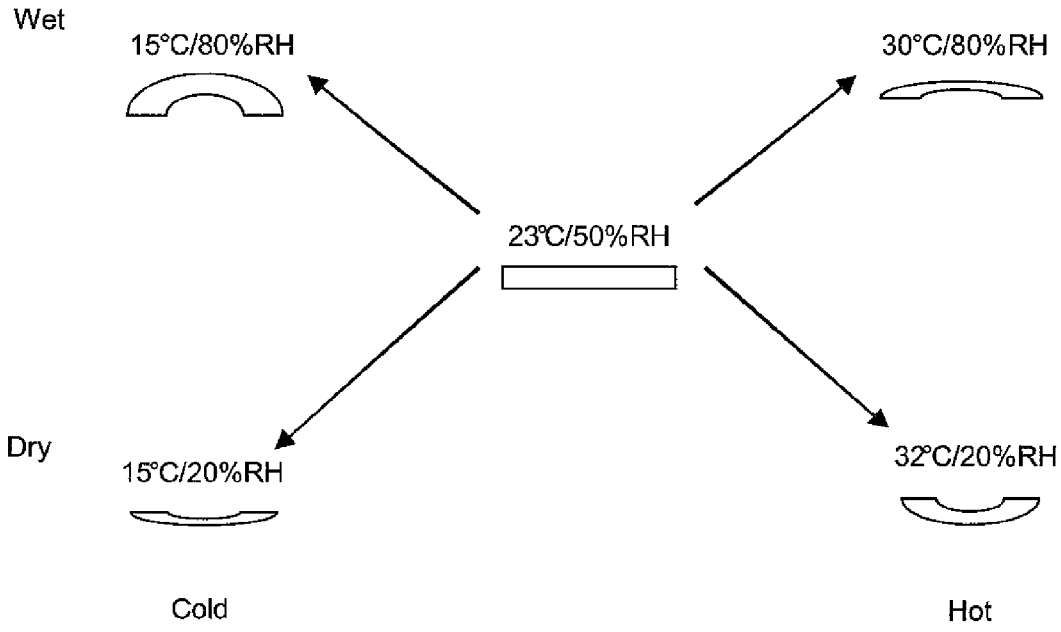
FIGS. 5A-B are schematic diagrams that show the curvature generated in final photo papers when subjected to the environmental conditions wet/cold, dry/cold, wet/hot and dry/hot. A: a comparative prior art photo paper; B: a pre-stressed photo paper according to various embodiments.
Figure 5B:
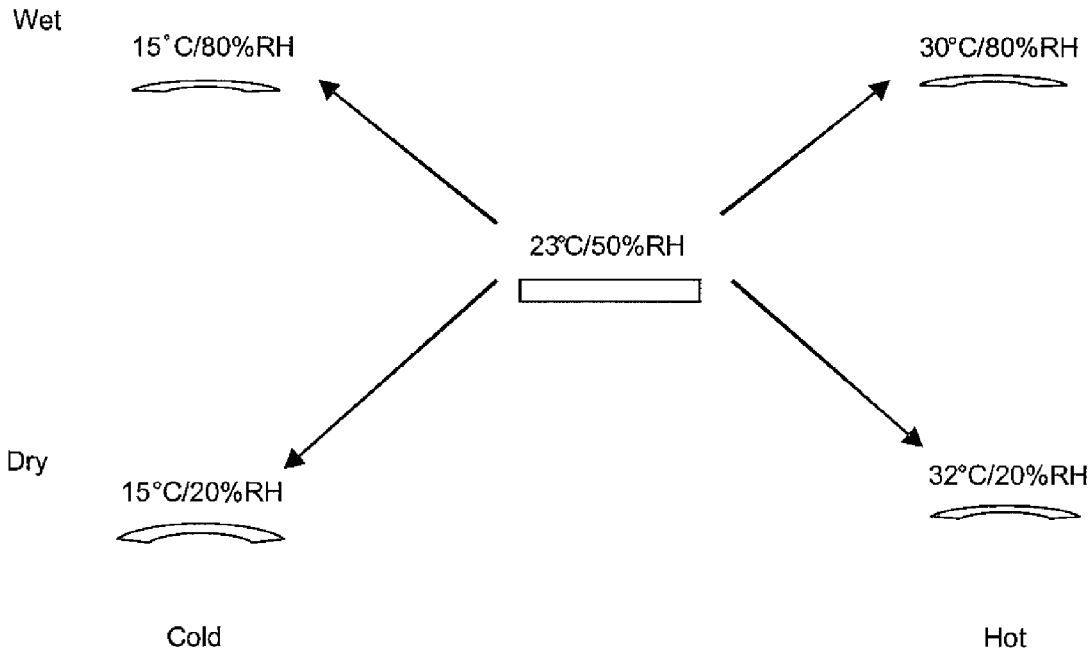

A comparison of the curvature generated in final photo papers corresponding to the exemplary products and in typical prior art photo papers is shown as schematic diagrams in FIGS. 5A-B. The relative curvature generated in final photo papers when subjected to the environmental conditions wet/cold, dry/cold, wet/hot and dry/hot (15° C./80% RH; 15° C./20% RH; 30° C./80% RH; and 32° C./20% RH, compared to the standard Technical Association for the Pulp and Paper Industries' (TAPPI) condition at 23° C./50% RH, are shown. FIG. 5A shows the results with a comparative prior art photo paper (HP Advanced Photo Paper, Hewlett-Packard Company), and FIG. 5B shows the results for exemplary pre-stressed photo papers under the same conditions.

Figure 6:
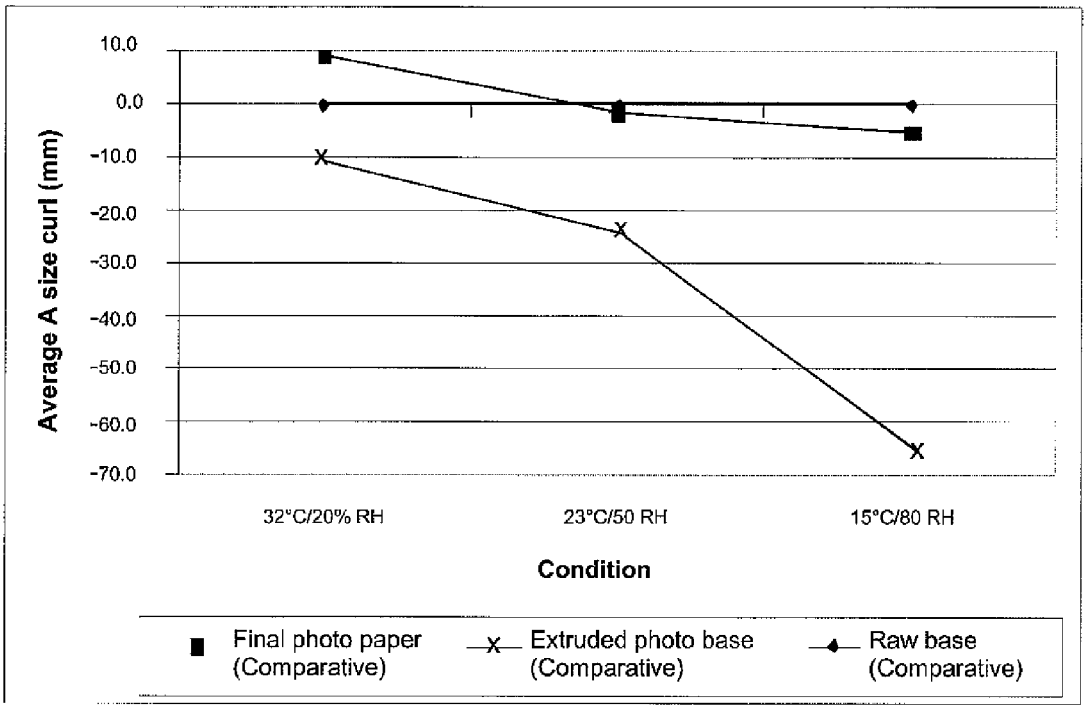
FIG. 6 is a graph showing how curl changes with environmental conditions for a comparative prior art photo base and a final photo paper product in accordance with various embodiments. The X-axis is the three different environmental conditions.

The graph shown in FIG. 6 demonstrates how curl changes with environmental conditions in a typical (prior art) raw base, resin-coated photo base and final inkjet photographic paper. The X-axis is the three different environmental conditions (23° C./50% RH, 32° C./20% RH and 15° C./80% RH). The level of curl is shown on the Y-axis (negative curl numbers indicate curl towards the back side). High negative curl indicates a high level of pre-stress. In these examples, the pre-stress is reduced when comparing base in 23° C./50% RH, vs. 32° C./20% RH while pre-stress level increases when the base is conditioned in 15° C./80% RH vs. 23° C./50% RH.

Figure 7:
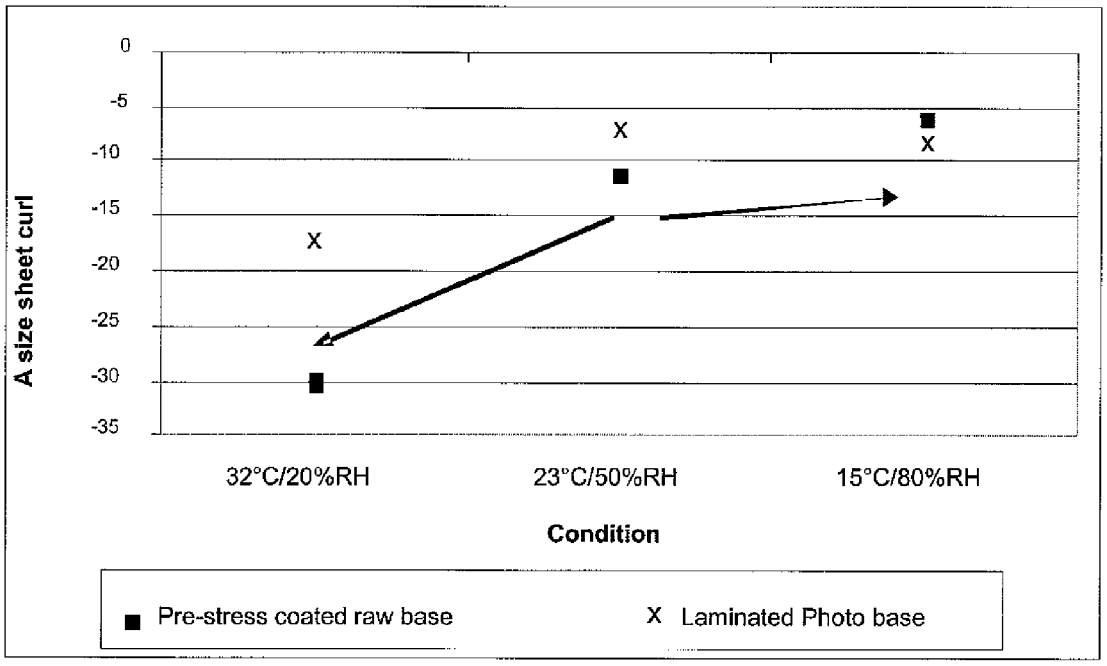
FIG. 7 is a graph showing how curl changes with environmental conditions for a pre-stressed photo base according to various embodiments (exemplified by Sample 1). Y-axis is average curl, and the X-axis is three different environmental conditions.

The graph shown in FIG. 7 is similar to that of FIG. 6 except that it shows how curl changes with environmental conditions for the exemplary pre-stressed photo base of Sample 1 of the Examples. The average curl size (Y-axis) is plotted vs. three different environmental conditions, 23° C./50% RH, 32° C./20% RH and 15° C./80% RH (X-axis). The arrows in FIG. 7 show the direction of the change from 23° C./50% RH when going to the two demonstrated environmental corners that are historically the trouble points for photo papers. Unlike the prior art design, pre-stress in the exemplary sample (curl towards backside shown in Y-axis) is increased when comparing base in 23° C./50% RH, vs. 32° C./20% RH while the pre-stress level decreased when the base is conditioned in 15° C./80% RH vs. 23° C./50% RH. The high pre-stress in 32° C./20% RH will help reduce curl towards image side due to micro-porous imaging layer shrinkage, and backside PE expansion. The reduced pre-stress in 15° C./80% RH will also avoid too much negative curl towards the back side due to micro-porous imaging layer expansion and backside PE shrinkage. The result is that the final photo paper will remain flat or nearly flat at all environmental conditions.

Figure 8:
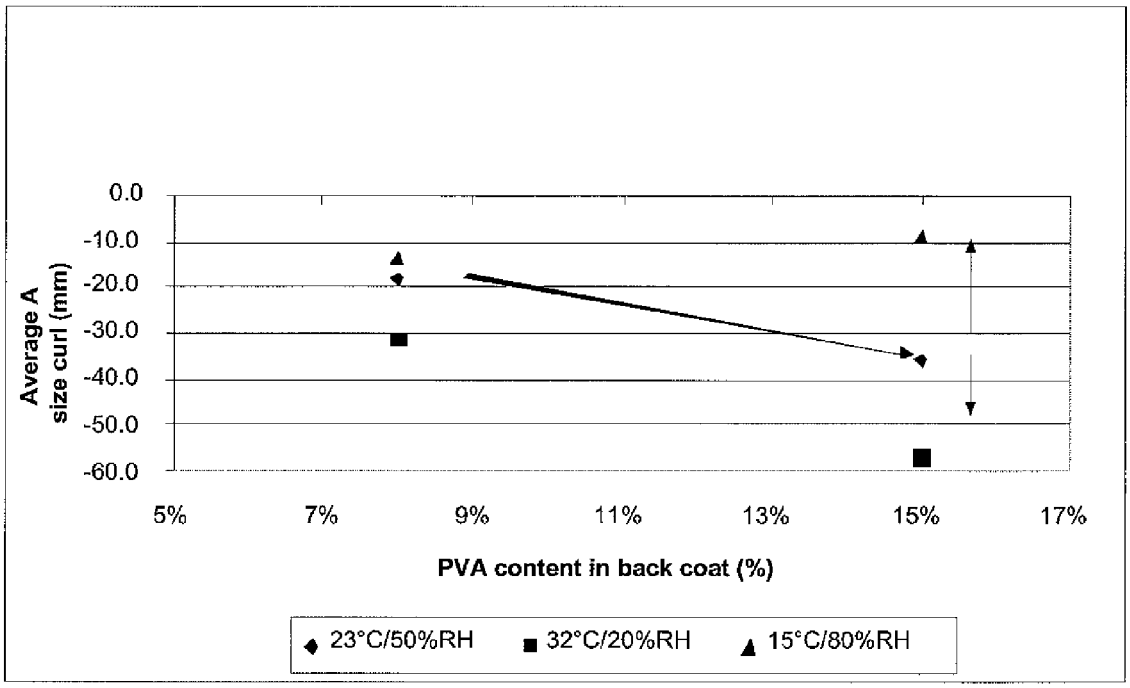
FIG. 8 is a graph showing the curl changes for a pre-stressed photo base according to various embodiments as water soluble binder level changes in the backside coating.

Curl changes for the exemplary pre-stressed photo bases of Samples 2 and 3 as water soluble binder level changes in the backside coating are shown as a graph in FIG. 8. Data is presented for both pre-stress coated raw base paper 12 and laminated photo base paper 14, constructed as illustrated in FIG. 1. Negative curl indicates curl toward the back side. High negative curl indicates a high level of pre-stress. In this plot, the weight % of water soluble binder (exemplified by PVA) in the back side pre-stress coat 104 was varied while both the front side and back side coat weights of layer 101 and 104 were kept constant at 8 gsm and 15 gsm, respectively. The PVA level in the backside coating 104 is shown on the X-axis. Increased PVA level in the backside coating will increase the level of pre-stress (curl to backside). This demonstrates the range of pre-stress modification that is possible in some embodiments.

Figure 9:
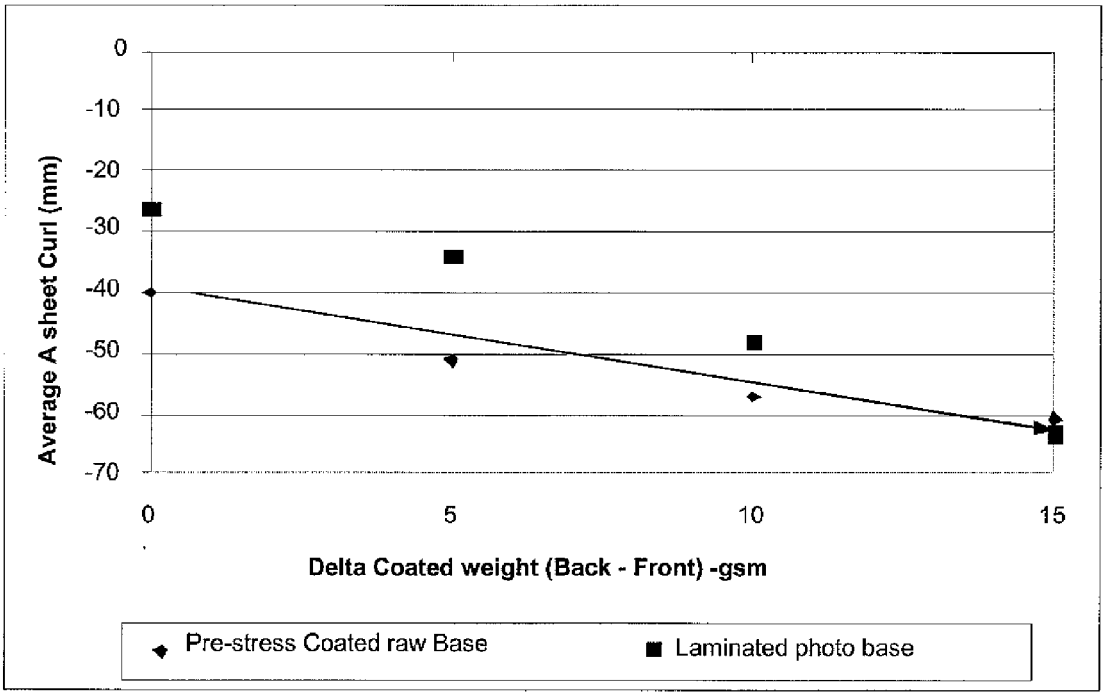
FIG. 9 is a graph showing the curl changes for a pre-stressed photo base according to various embodiments as front side coat weight changes.

FIG. 9 is a graph showing the curl changes for exemplary pre-stressed raw base papers 12 and laminated photo base papers 14 for Samples 3-6 of the Example. Data is presented for both pre-stress coated raw base paper 12 and laminated photo base paper 14 (structured as schematically illustrated in FIG. 1). Negative curl indicates curl toward the back side, and high negative curl indicates a high level of pre-stress. In this plot, the front side coat weight is varied while the backside coat weight was kept constant at 15 gsm, and the weight % of water soluble binder (exemplified by PVA) was kept constant at 15 wt % in the back side coat 104. Further design flexibility is demonstrated in this graph.

Figure 10:
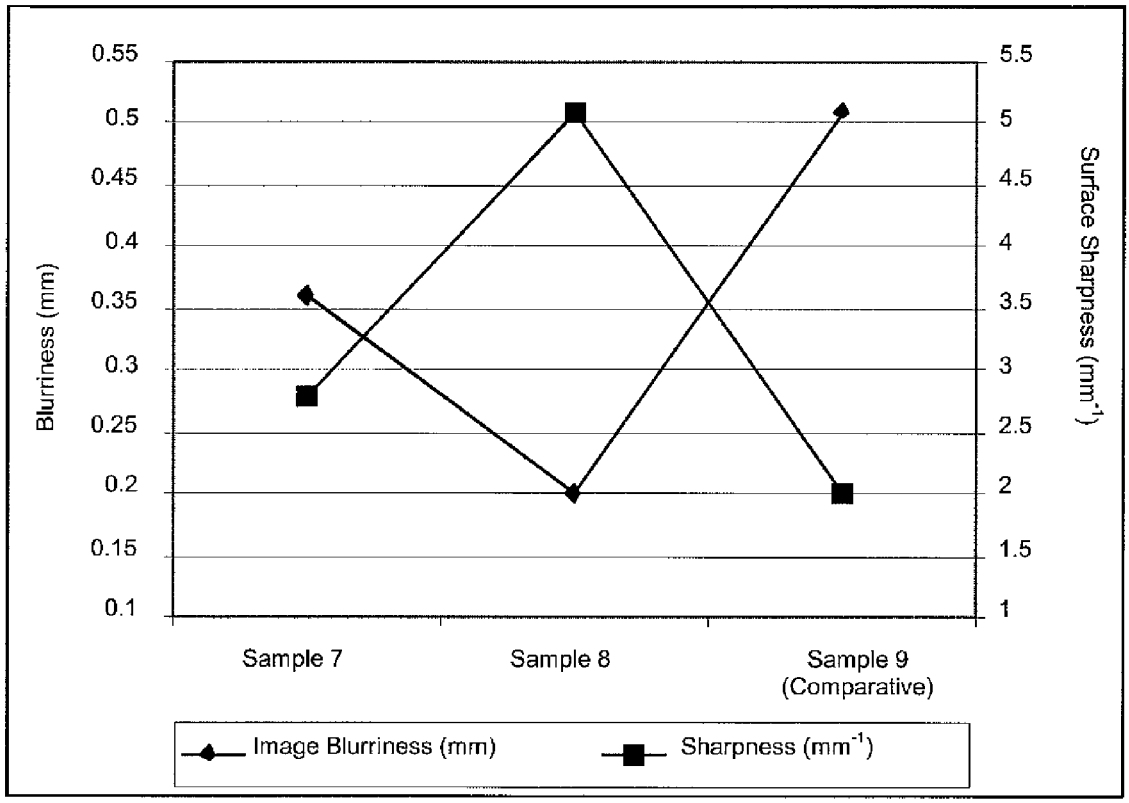
FIG. 10 is a graph showing the image blurriness and sharpness levels of pre-stressed photo bases according to various embodiments, and of a comparative prior art photo base.

FIG. 10 is a graph showing the relative image blurriness and sharpness of exemplary pre-stressed photo bases, compared to a prior art photo base. These print qualities were measured using a DIAS instrument from Quality Engineering Associates, Inc. Lower blurriness value and higher sharpness value of a sample photo base correlated with better image clarity or perceived gloss. Sample 8 in the Examples, containing the two layer design in front side coating 101', as illustrated in FIG. 2 gave the best sharpness and least blurriness. Sample 7, having the one layer pre-stress coating design on the front side (e.g., layer 101 of FIG. 1), had better sharpness and less blurriness than Sample 9 (representative prior art design).

Certain embodiments of the photographic papers for inkjet printing described herein offer improved curl management across a range of environmental conditions, while maintaining perceived image gloss of the final product. In some embodiments, the disclosed method of manufacturing a pre-stressed resin coated raw base paper provides a final photo paper that will remain flat or nearly flat over a wide range of environmental conditions, including 15-32° C. and 20-80% relative humidity. In some embodiments, the initial degree of pre-stress downward curl in the final photo paper is in the range of about −5 mm to about 5 mm at any environmental condition in the range of 15-32° C. and 20-80% relative humidity. The final photo paper, after receiving an inkjet printed image, is resistant to positive and negative curl, over the above-stated range of environmental conditions (e.g., during storage or shipping). In some embodiments, after use for inkjet printing, a printed photo paper remains substantially flat or has an upward or downward curl of no more than about ±5 mm over the above-stated range of temperature and humidity. Embodiments of the pre-stressed photo papers offer reduced risk of being scraped by a print head during use, and of causing sheet feeding problems in a printer's paper handling tray. Thus, the potential for causing a print jam or print defect is also reduced.

In accordance with certain embodiments a pre-stressed substrate for a photographic paper is provided that comprises: (a) a base paper having a front surface and a back surface, (b) a top pre-stress coat on the front surface, the top pre-stress coat comprising a first pre-stress mixture containing at least a first pigment, a first binding material ($TBM_1$) comprising a first water soluble binder ($WSB_1$) and a first water-dispersible binder ($WDB_1$); and (c) a back pre-stress coat on the back surface, the back pre-stress coating comprising a second pre-stress mixture containing at least a second pigment, a second binding material ($TBM_2$) comprising a second water soluble binder ($WSB_2$) and, optionally, a second water dispersible binder ($WDB_2$), wherein the weight % of $WSB_1$ in the $TBM_1$ is less than the weight % of $WSB_2$ in the $TBM_2$. The pre-stressed substrate has a predetermined degree of curvature toward the back surface and is capable of countering curling forces that occur during image receiving layer coating and final product use.

In some embodiments, the top pre-stress coat comprises ($b_1$) a first pre-stress coat containing the first pigment and the first binding material, and ($b_2$) a pre-stress undercoat disposed between the front surface of the base paper and the first pre-stress coat, the pre-stress undercoat comprising a third pigment and a third binding material ($TBM_3$).

In some embodiments, the third pigment in the pre-stress undercoat has an equal or lower mean surface area and an equal or higher mean particle size than the first pigment in the first pre-stress coat. In some embodiments, the $TBM_3$ in the pre-stress undercoat comprises a third water soluble binder ($WSB_3$) and a third water dispersible binder ($WDB_3$). In some embodiments, the $TBM_3$ in the pre-stress undercoat is the same as the $TBM_1$. In some embodiments, the amount of the $WSB_1$ is <50% by weight of the $TBM_1$, and the amount of the $WSB_2$ is >50% by weight of the $TBM_2$. In some embodiments, the $TBM_1$ is <10 wt % $WSB_1$, and the $TBM_2$ is >10 wt % $WSB_2$.

In some embodiments, the back pre-stress coat comprises a coat weight 1-3 times greater than that of the top pre-stress coat. In some embodiments, the top pre-stress coat comprises a coat weight in the range of about 5 to about 25 gsm, and the back pre-stress coat comprises a coat weight in the range of about 10 to 30 gsm. In some embodiments, the substrate has the curvature toward the back surface when the substrate is at 15° C. and 20-80% relative humidity, or 30° C. and 20-80% relative humidity.

In some embodiments, an above described pre-stressed substrate further comprises (d) a first polymeric film layer on the top pre-stress coat; and (e) a second polymeric film layer on the back pre-stress coat. In some embodiments, the ratio of the second polymeric film layer coat weight to the first polymeric film layer coat weight is less than 2.

In accordance with certain embodiments, a photographic paper is provided that comprises an above-described film coated pre-stressed substrate, also referred to as a pre-stressed photographic base paper, and a microporous image receiving layer disposed on the first polymeric film layer. In some embodiments, the photographic paper further comprises a printed inkjet image on the image-receiving layer, and the image-containing photographic paper is resistant to curling at environmental conditions ranging from about 15-32° C. and about 20-80% relative humidity.

In accordance with still other embodiments, a method of making an above-described curl-resistant paper is provided that comprises: (a) applying to a front surface of a raw base paper a top pre-stress coat comprising a first pre-stress mixture including at least a first pigment and a first binding material ($TBM_1$) comprising a first water soluble binder ($WSB_1$) and a first water dispersible binder ($WDB_1$); and (b) applying to a back surface of the base paper a second pre-stress mixture containing a second pigment and a second binding material ($TBM_2$) comprising a second water soluble binder ($WSB_2$) and, optionally, a second water dispersible binder ($WDB_2$), to form a back pre-stress coat on the back surface. The weight % of $WSB_1$ in the $TBM_1$ applied to the front surface is less than the weight % of $WSB_2$ in the $TBM_2$ applied to the back surface, whereby a pre-stressed base paper is obtained which resists curling in environmental conditions in the range of 15-32° C. and 20-80% relative humidity.

In some embodiments of an above-described method, (a) includes: ($a_1$) applying to the front surface a third pre-stress mixture comprising a third pigment and a third binder material comprising a third water soluble binder and a third water dispersible binder, to form a pre-stress undercoat on the front surface, and ($a_2$) applying onto the pre-stress undercoat the first pre-stress mixture, to form a first pre-stress coat on the pre-stress undercoat.

In some embodiments of an above-described method, the third pigment in the pre-stress undercoat has a equal or lower mean surface area and equal or higher mean particle size than the first pigment in the first pre-stress coat. In some embodiments, the third binding material in the pre-stress undercoat comprises a third water soluble binder and a third water dispersible binder. In some embodiments, the third binder material in the pre-stress undercoat is the same as the first binding material in the first pre-stress coat. In some embodiments, the $WSB_1$ in the top pre-stress coat is <50 wt % of the $TBM_1$, and the $WSB_2$ in the back pre-stress coat is >50 wt % of the $TBM_2$.

In certain embodiments, an above-described method further includes: step (c) forming a first polymeric film on the top pre-stress coat; and step (d) forming a second polymeric film on the back pre-stress coat, to obtain a pre-stressed photographic base paper. In some embodiments, the first and second polymeric films have a weight ratio of the second polymeric film to the first polymeric film is less than 2.

In some embodiments, an above-described method includes (b') calendaring the pre-stressed base paper from (b) to the paper machine, prior to (c) and (d). In some embodiments, in step (c), the forming comprises extruding the first polymeric film onto the top pre-stress coat, and in step (d), the forming comprises extruding the second polymeric film onto the back pre-stress coat. In some embodiments, an above-described method includes step (e), applying a porous ink-receiving layer onto the first polymeric film.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A pre-stressed substrate for a photographic paper comprising:

(a) a base paper having a front surface and a back surface, (b) a top pre-stress coat on said front surface, said top pre-stress coat comprising a first pre-stress mixture containing at least a first pigment, a first binding material ($TBM_1$) comprising a first water soluble binder ($WSB_1$) and a first water-dispersible binder ($WDB_1$);

(c) a back pre-stress coat on said back surface, said back pre-stress coating comprising a second pre-stress mixture containing at least a second pigment, a second binding material ($TBM_2$) comprising a second water soluble binder ($WSB_2$) and, optionally, a second water dispersible binder ($WDB_2$), wherein the weight % of $WSB_1$ in the $TBM_1$ is less than the weight % of $WSB_2$ in the $TBM_2$;

(d) a first polymeric film layer on said top pre-stress coat; and (e) a second polymeric film layer on said back pre-stress coat, wherein said pre-stressed substrate has a predetermined degree of curvature toward the back surface and is capable of countering curling forces that occur during image receiving layer coating and final product use.

2. The pre-stressed substrate of claim 1, wherein, in (b), said top pre-stress coat comprises ($b_1$) a first pre-stress coat containing said first pigment and said first binding material, and ($b_2$) a pre-stress undercoat disposed between said front surface of said base paper and said first pre-stress coat, said pre-stress undercoat comprising a third pigment and a third binding material ($TBM_3$).

3. The pre-stressed substrate of claim 2, wherein said third pigment in said pre-stress undercoat has an equal or lower mean surface area and an equal or higher mean particle size than said first pigment in said first pre-stress coat.

4. The pre-stressed substrate of claim 2, wherein said $TBM_3$ in said pre-stress undercoat comprises a third water soluble binder ($WSB_3$) and a third water dispersible binder ($WDB_3$).

5. The pre-stressed substrate of claim 1, wherein the amount of said $WSB_1$ is <50% by weight of said $TBM_1$, and the amount of said $WSB_2$ is >50% by weight of said $TBM_2$.

6. The pre-stressed substrate of claim 1, wherein said $TBM_1$ is <10 wt % $WSB_1$, and said $TBM_2$ is >10 wt % $WSB_2$.

7. The pre-stressed substrate of claim 1, wherein said back pre-stress coat comprises a coat weight 1-3 times greater than that of said top pre-stress coat.

8. The pre-stressed substrate of claim 1, wherein said substrate has said curvature toward the back surface when said substrate is at 15° C. and 20-80% relative humidity, or 30° C. and 20-80% relative humidity.

9. The pre-stressed substrate of claim 1, wherein the ratio of said second polymeric film layer coat weight to said first polymeric film layer coat weight is less than 2.

10. A photographic paper comprising:

a pre-stressed substrate according to claim 1; and a microporous image receiving layer disposed on said first polymeric film layer.

11. The photographic paper of claim 10, wherein said paper further comprises a printed inkjet image on said image-receiving layer, and said image-containing photographic paper is resistant to curling at environmental conditions ranging from about 15-32° C. and about 20-80% relative humidity.

12. A method of making a curl-resistant paper, comprising:

(a) applying to a front surface of a raw base paper a top pre-stress coat comprising a first pre-stress mixture including at least a first pigment and a first binding material ($TBM_1$) comprising a first water soluble binder ($WSB_1$) and a first water dispersible binder ($WDB_1$);

(b) applying to a back surface of said base paper a second pre-stress mixture containing a second pigment and a second binding material ($TBM_2$) comprising a second water soluble binder ($WSB_2$) and, optionally, a second water dispersible binder ($WDB_2$), to form a back pre-stress coat on said back surface, wherein the weight % of $WSB_1$ in the $TBM_1$ applied to said front surface is less than the weight % of $WSB_2$ in the $TBM_2$ applied to said back surface;

(c) forming a first polymeric film on said top pre-stress coat; and (d) forming a second polymeric film on said back pre-stress coat, to obtain a pre-stressed photographic base paper, whereby a pre-stressed base paper is obtained which resists curling in environmental conditions in the range of 15-32° C. and 20-80% relative humidity.

13. The method of claim 12, wherein in (a), said applying comprises ($a_1$) applying to said front surface a third pre-stress mixture comprising a third pigment and a third binder material comprising a third water soluble binder and a third water dispersible binder, to form a pre-stress undercoat on said front surface, ($a_2$) applying onto said pre-stress undercoat said first pre-stress mixture, to form a first pre-stress coat on said pre-stress undercoat.

* * * * *

UNITED STATES PATENT AND TRADEMARK OFFICE

CERTIFICATE OF CORRECTION

PATENT NO. : 8,734,919 B2
APPLICATION NO. : 13/201448
DATED : May 27, 2014
INVENTOR(S) : Fu et al.

It is certified that error appears in the above-identified patent and that said Letters Patent is hereby corrected as shown below:

On the Title page, in Item [73], delete "Development-Company, L.P.," and insert -- Development Company, L.P., --, therefor.

Signed and Sealed this
Twenty-third Day of September, 2014

Michelle K. Lee

Michelle K. Lee
*Deputy Director of the United States Patent and Trademark Office*